United States Patent [19]

Holland

[11] 3,994,391

[45] Nov. 30, 1976

[54] SPECTACLE CLIP CASE

[76] Inventor: Marvin J. Holland, 700 NE. 14th Ave., Hallandale, Fla. 33009

[22] Filed: Jan. 29, 1976

[21] Appl. No.: 653,495

[52] U.S. Cl. ..... 206/5; 206/6; 24/3 C; 24/3 G

[51] Int. Cl.[2] ..... A45C 11/04

[58] Field of Search ..... 206/5, 6; 24/3 C, 3 G, 24/3 H, 3 J, 3 L

[56] References Cited

UNITED STATES PATENTS

| | | | |
|---|---|---|---|
| 2,809,766 | 10/1957 | Anderson | 206/6 X |
| 3,148,812 | 9/1964 | Hilsinger, Jr. | 206/5 |
| 3,749,231 | 7/1973 | Nathan | 206/5 |

*Primary Examiner*—George T. Hall
*Attorney, Agent, or Firm*—John B. Dickman, III

[57] ABSTRACT

An eyeglass carrying case of an improved design including a preformed fold line along the rear wall of the case and a pivotally attached carrying clip above the preformed fold line. The improved design of the eyeglass carrying case allows eyeglass wearers to carry their eyeglasses on their belts and waist bands without fear of breaking the eyeglasses.

4 Claims, 6 Drawing Figures

SPECTACLE CLIP CASE

BACKGROUND OF THE INVENTION

The eyeglass cases currently in use are designed to be carried in a shirt pocket or a jacket pocket. However, there are many occasions when a person does not have a pocket available, such as when the shirt or jacket does not have a pocket, or when not wearing a shirt.

A common complaint with respect to prior art cases is that they are not adaptable for carrying on a belt or waist band. They do not adjust to the normal human body movements of bending and twisting; therefore, a sudden bend or twist can and quite often does spell disaster for the eyeglasses in the case. Commonly an eyeglass case has a fixed carrying clip for attaching to a pocket, such as the clip of U.S. Pat. No. 2,809,766, issued Oct. 15, 1957 to Anderson. The Anderson eyeglass case does not conform to any bending or twisting, since the case is of a rigid construction. In U.S. Pat. No. 467,386, issued Jan. 19, 1892, to Steadley and U.S. Pat. No. 1,070,496, issued Aug. 19, 1913, to Lowenberg, the eyeglass case is provided with a hook for attaching the case to a garment. In the patent to Steadley the hook or safety pin is attached to a swivel to hold the case rigid when the wearer bends or stoops. The Steadley case is designed to hold the case rigid in a pocket allowing for only movement relatively between the case and the pin.

SUMMARY OF THE INVENTION

Briefly, the invention is an eyeglass carrying case with a preformed fold line for bending the upper portion of the case in relation to the lower portion as when the wearer sits down with the case clipped to the side or rear of his belt. The upper portion is also provided with a carrying clip that pivots about the connection between it and the case. This pivot allows the case to swing relative to the belt to which the clip is fastened, thereby preventing damage to the eyeglasses from the wearer bending or twisting.

BRIEF DESCRIPTION OF THE DRAWINGS

The novel features that are considered characteristic of the invention are set forth in the claims. The invention itself, however, both as to its organization and its method of operation, together with additional objects and advantages thereof, will best be understood from the following description when read in connection with the accompanying drawings, wherein like reference characters indicate like parts throughout the several figures and in which:

DETAILED DESCRIPTION OF THE INVENTION

Figure 1:
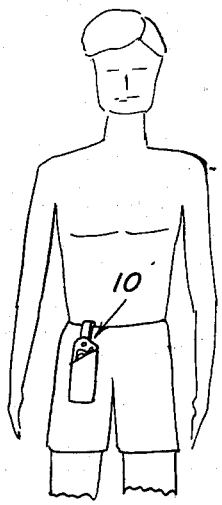
FIG. 1 illustrates an eyeglass case of this invention carried on the waist band of an eyeglass wearer.

Referring now to the drawings in detail, FIG. 1 shows a person in a pair of shorts or bathing trunks with an eyeglass carrying case 10 attached to his waist band. The eyeglass case 10 has a pocket 12, best seen in FIGS. 5 and 6. The case may be constructed from a single or double thickness of material such as soft leather or plastic, folded to form the pocket 12, or two separate pieces of single or double thickness of material sewn together. The front wall 14 of the case 10 has a slanted upper edge 16 which allows for easy removal and insertion of the eyeglasses (not shown). The rear portion 18 which along with the front 14 forms the pocket 12 completes what is known in the prior art.

Figure 2:
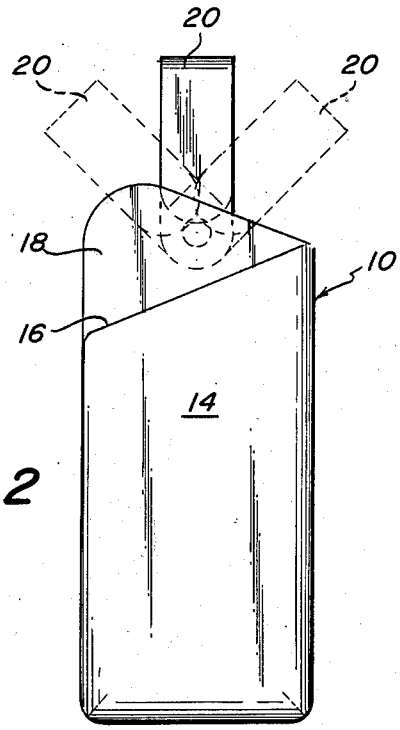
FIG. 2 is a front plan view of an eyeglass case of this invention.

In FIG. 2 the case 10 is shown with a carrying clip 20 for attaching to belts and waist bands, as in FIG. 1. The clip is shown in invisible lines pivoting about a post 22, best seen in FIG. 6. The post 20 is shown as a two headed rivet with a shank 24, a large head 26 and a smaller head 28. There are several arrangements for fastening the clip 20 to the case 10 using a post 20. One of these arrangements includes forming a pocket for the rivet head between the double thickness of material forming the case shown in FIG. 6. The important feature in fastening the clip to the case is to make sure that the clip pivots relative to the case as in FIG. 1; therefore, the clip 20 must be freely rotatable on post 22. The clip 20 is generally a U-shaped piece of metal with one leg longer than the other for riveting to the case 10.

Figure 3:
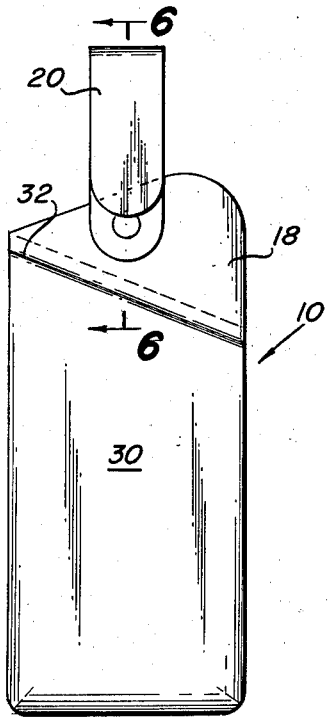
FIG. 3 is a rear plan view of an eyeglass case of this invention.

FIG. 3 shows the rear wall 30 of case 10 with clip 20 riveted to the upper end of the wall. Along a line parallel but not necessarily adjacent to edge 16 of front wall 14 is a preformed fold line 32 which allows the rear wall 30 to bend as in FIG. 5. To make sure that the wall 30 bends along fold line 32, the wall 30 may be sewn along the line as in a double material thickness in the preferred embodiment, or scored in the case of a single ply of leather or plastic.

Figure 4:
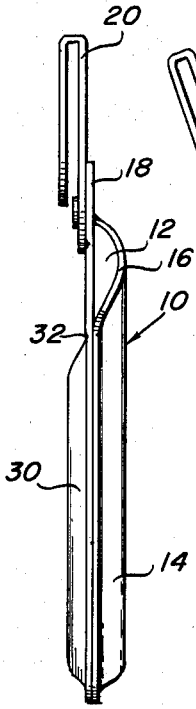
FIG. 4 is a side view of an eyeglass case of this invention.
Figure 5:
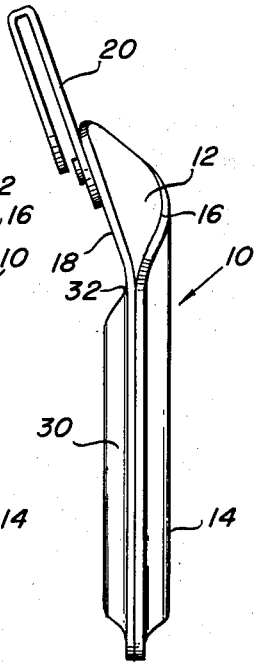
FIG. 5 is another side view of an eyeglass case of this invention showing the upper portion flexing.
Figure 6:
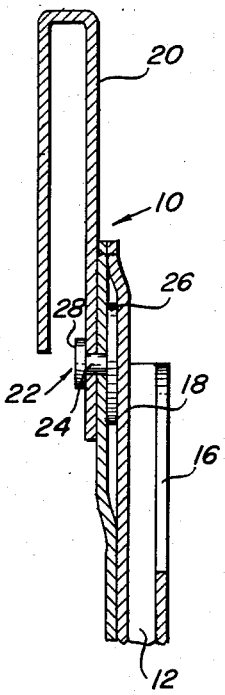
FIG. 6 is a sectional view along the line 6—6 of FIG. 3 showing the pivot and carrying clip of this invention.

The eyeglass case 10 in FIG. 4 shows the case 10 as it would normally hang from a belt or waist band, whereas FIG. 5 shows the same case 10 twisted and bent from the wearer's movements.

Although a single specific embodiment of the invention has been shown and described, it is obvious that many modifications as to materials and design are possible. The invention, therefore, is not to be restricted except insofar as is necessitated by the appending claims.

I claim:

1. An eyeglass carrying case for attaching to a belt or waist band comprising an eyeglass case having a front wall and a rear wall forming a pocket for a pair of eyeglasses, and said rear wall extending above said front wall; a pivotable carrying clip attached to said rear wall in a manner to hang from a belt with said pocket and said front wall exposed, and a preformed fold line in said rear wall whereby said carrying case will bend and twist.

2. An eyeglass carrying case as in claim 1 and wherein said carrying clip is fastened to said carrying case by a rivet post.

3. An eyeglass carrying case as in claim 1 and wherein said front wall has a slanted upper edge and said preformed fold line is parallel to said upper edge.

4. An eyeglass carrying case as in claim 2 and wherein said case is a double thickness of material forming a rivet pocket for fastening said case to said carrying clip by said rivet post retained in said rivet pocket.

* * * * *